US005623761A

United States Patent [19]

Chiang

[11] Patent Number: 5,623,761

[45] Date of Patent: Apr. 29, 1997

[54] BEARING REMOVING DEVICE

[76] Inventor: Chen-Chi Chiang, 3/F., No. 13, Alley 100, Lane 155, Tun Hwa N Rd., Taipei, Taiwan

[21] Appl. No.: 417,384

[22] Filed: Apr. 5, 1995

[51] Int. Cl.[6] ..... B21D 53/10

[52] U.S. Cl. ..... 29/724; 29/260; 29/270

[58] Field of Search ..... 29/260, 258, 259, 29/256, 724, 270

[56] References Cited

U.S. PATENT DOCUMENTS

| | | | |
|---|---|---|---|
| 2,262,555 | 11/1941 | Marcellus | 29/260 |
| 3,383,755 | 5/1968 | Chmielewski | 29/724 |
| 4,694,569 | 9/1987 | Colvell et al. | 29/260 |
| 4,724,608 | 2/1988 | Parrott | 29/724 |
| 5,033,180 | 7/1991 | Colson | 29/259 |
| 5,228,180 | 7/1993 | Baur et al. | 29/259 |
| 5,255,435 | 10/1993 | Shultz | 29/259 |

*Primary Examiner*—Irene Cuda
*Assistant Examiner*—Marc W. Butler
*Attorney, Agent, or Firm*—Bacon & Thomas

[57] ABSTRACT

A bearing removing device includes an elongated tubular member having an end receivable within an inner hole of a bearing is removed. A plurality of holes having a tapering configuration is spaced along a circumference of the end of the tubular member. The tubular member has a central through hole to receive therein a shaft member in such a manner to be movable between a first position and a second position. The end of the shaft member has one or more raised portions to be in contact engagement with the spherical members for driving the latter partially out of the holes. A support member is placed around the bearing to be removed. A nut member threadingly engaging a threaded section of the tubular member to abut against the support member is tightened against the support member such that the tubular member is moved relative to the support member.

12 Claims, 13 Drawing Sheets

BEARING REMOVING DEVICE

FIELD OF THE INVENTION

The present invention relates generally to a bearing removing device for enhancing manual removal of bearing out of bearing seat.

BACKGROUND OF THE INVENTION

Bearings are a commonly used mechanical element for supporting rotational movement of mechanical parts, such as shaft. The bearings have a limited service life and have to be replaced when worn out. However, since bearings are usually press-fit into and tightly secured within bearing seats, which may assume the form of a hole, it requires a great effort or special tools for removing the bearings out of the bearing seat. Such a situation is shown, as an example, in FIGS. 17 and 18 of the attached drawings. In FIG. 17, a bearing 8 is shown mounted within a bearing seat or hole 9 and is to be removed while in FIG. 18, only the outer race member 82 of the bearing 8 is left within the hole 9 which may be resulted from improper attempt to remove the bearing 8 out of the bearing seat 9 or any other damage to the bearing 8.

One conventional manner to remove a bearing 8 or the outer race member 82 thereof out of the bearing seat 9 is done by welding a bar or an elongated member (not shown) to the bearing 8 or the outer race member 82 to provide the operator with a handle for easy application of pulling force to move the bearing 8 or the outer race member 82 out of the hole 9.

Another conventional manner for removing the bearing 8 is using a bearing removing device. In FIG. 19, a conventional bearing removing device 7 is shown, which comprises three paw members 711 formed on rotatable arms 71. The arms 71 are initially positioned close to each to allow the paw members 711 to pass through the bearing hole 810 and are then controlled by a conic member 72 to rotate in such a manner to have the paw members 711 moved outward to engage one side of the bearing 8. By the engagement between the paw members 711 and the bearing 8, application of force to the bearing removing device 7 moves the bearing 8 out of the hole 9.

A disadvantage associated with such a conventional bearing removing device 7 is that there may be only a limited spacing left between the one side of the bearing that is to be engaged by the paw members 711 and the bearing seat 9, such as the spacing 91 shown in FIGS. 17 and 18. If spacing 91 is not large enough to receive the paw members 711 to be located behind the bearing 8, the conventional bearing removing device 7 will be totally useless in removing the bearing 8 out of the hole 9.

Furthermore, the arms 71 of the conventional bearing removing device 7 are usually subject to great moment acting thereon for there is a distance between the conic member 72 that applies a force to rotate the arms 71 outward and the contact engagement between the paw members 711 and the bearing 8 and such a distance together with the reaction force of the bearing 8 acting upon the paw members 711 results in a moment acting upon the arms 71. This causes the conventional bearing removing device 7 very easy to be damaged.

It is therefore desirable to provide a bearing removing device which overcomes the drawbacks of the conventional device.

SUMMARY OF THE INVENTION

The principal object of the invention is to provide a bearing removing device which takes only a very limited space when engaging with the bearing to be removed.

It is another object of the present invention to provide a bearing removing device which has a structure much stronger to take the reaction force during removal of bearing and thus have a longer service life.

In accordance with the present invention, there is provided a bearing removing device comprising an elongated tubular member having an end of a diameter receivable within an inner hole of a particular bearing to be removed. A plurality of holes having a tapering configuration spaced along a circumference of the end of the tubular member, each having a spherical member received therein. The tubular member has a central through hole to received therein a shaft member having an end receivable within the end of the tubular member in such a manner to be movable between a first position and a second position. The end of the shaft member has one or more raised portions to be in contact engagement with the spherical members for driving the latter partially out of the holes when the shaft member is in the first position and one or more recessed portions to partially receive the spherical members therein and thus retracting the latter completely into the tubular member when the shaft member is in the second position. A support member which is movably fit over the end of the tubular member is placed around the bearing to be removed to allow the end of the tubular member to enter into the bearing hole to have the spherical members that are partially protruding out of the end of the tubular member engage the bearing. A nut member threadingly engaging a threaded section of the tubular member to abut against the support member. By tightening the nut against the support member, the tubular member is moved relative to the support member so as to move the bearing that is engaged by the spherical members away from the bearing seat within which the bearing to be removed is fixed.

BRIEF DESCRIPTION OF THE DRAWINGS

The structure, features and other objects, functions and techniques of the present invention will be better understood from the following description of preferred embodiments thereof with reference to the attached drawings, wherein.

DETAILED DESCRIPTION OF THE PREFERRED EMBODIMENTS

Figure 1:
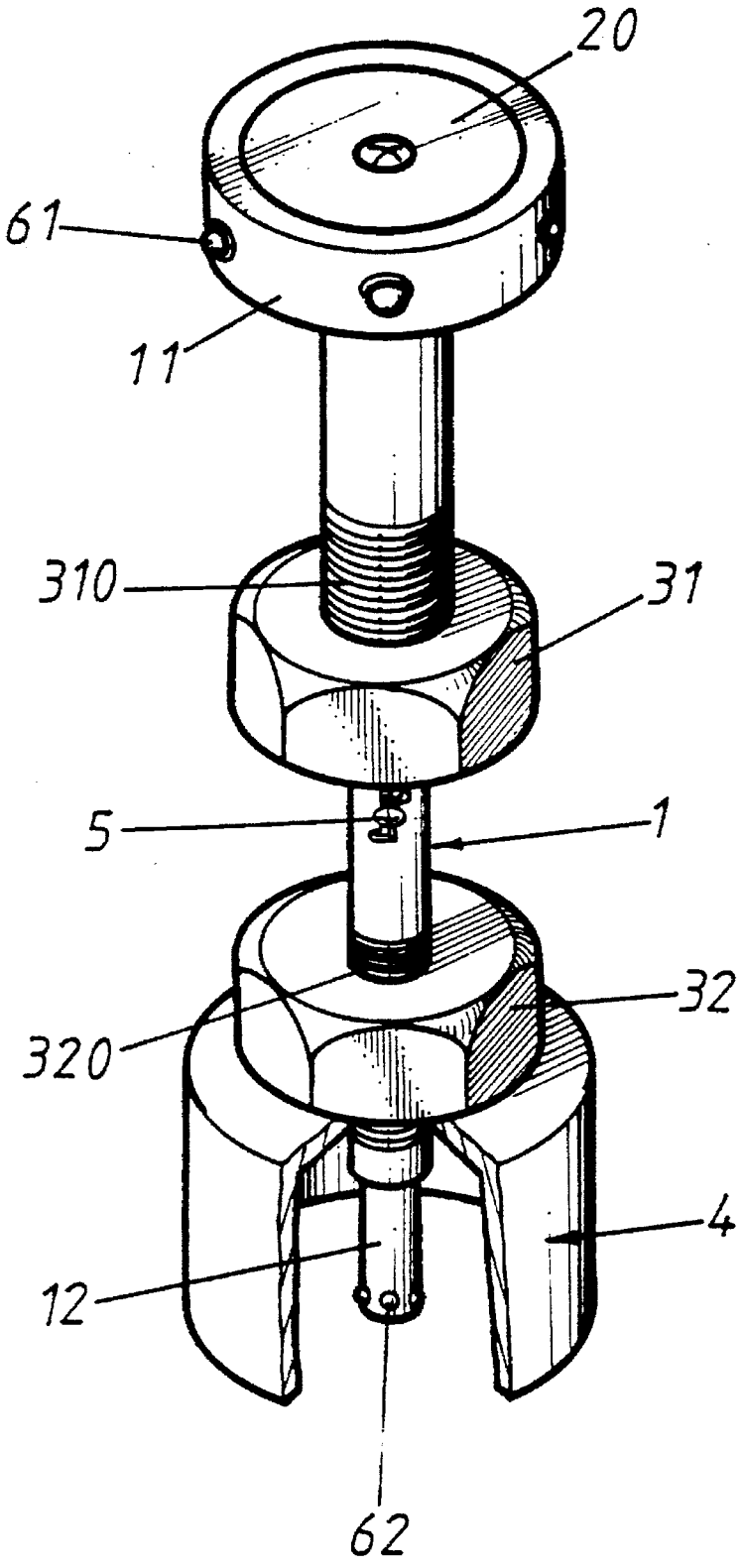
FIG. 1 is a perspective view, partially broken, showing a bearing removing device constructed in accordance with a first embodiment of the present invention.
Figure 2:
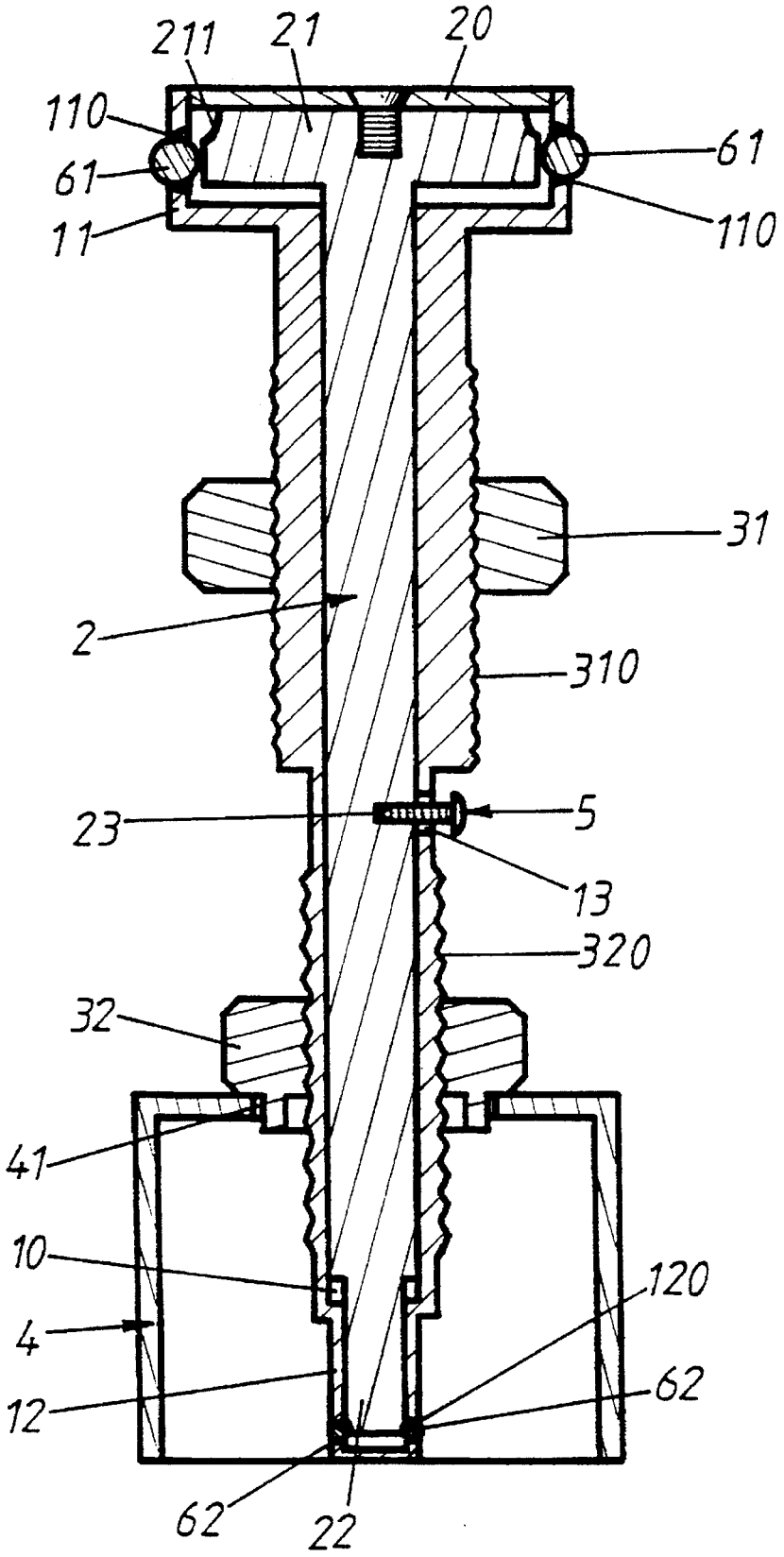
FIG. 2 is a longitudinal sectional view of the bearing removing device shown in FIG. 1.

With reference to the drawings and in particular FIGS. 1 and 2, wherein a bearing removing device constructed in accordance with the present invention is shown, the bearing removing device of the present invention comprises an elongated tubular member 1 having a central through hole 10 (FIG. 2). The tubular member 1 has an open first end 11 and a closed second end 12, respectively serving as a bearing outer race member removing means and a bearing inner race member removing means. The first end or the bearing outer race member removing means 11 has a diameter substantially corresponding to an inner diameter of an outer race member of a particular bearing, such as the outer race member 82 (FIGS. 17 and 18) of the bearing 8 (FIG. 17) to be receivable into the inner diameter of the outer race member 82, see FIG. 10. The second end or the inner race member removing means 12 has a diameter substantially corresponding to an inner diameter of an inner race member (such as the member referenced as 81 in FIG. 17) of the particular bearing 8 to be receivable into the inner diameter of the inner race member 81, see FIG. 7.

Figure 5:
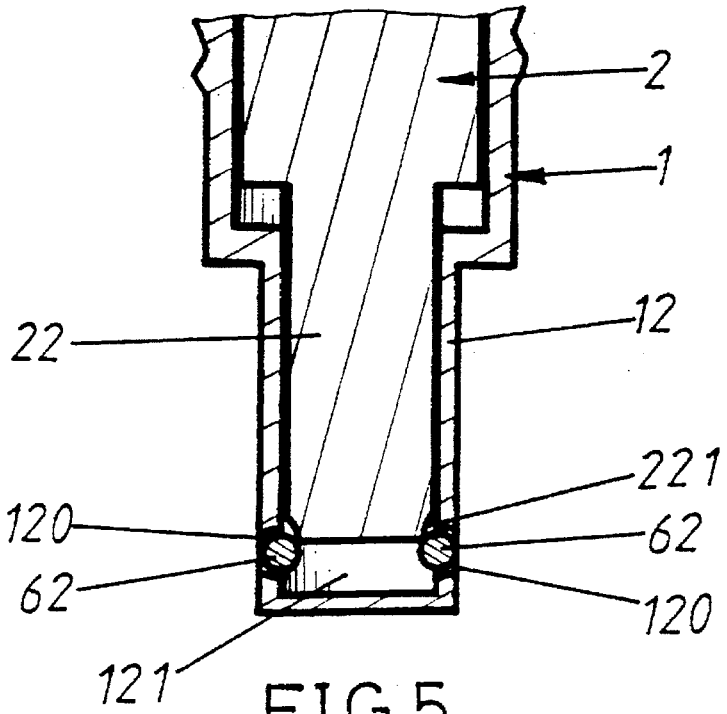
FIGS. 5 and 6 are cross-sectional views respectively showing the first and second positions of the bearing inner race member removing device of the first embodiment of the present invention.
Figure 6:
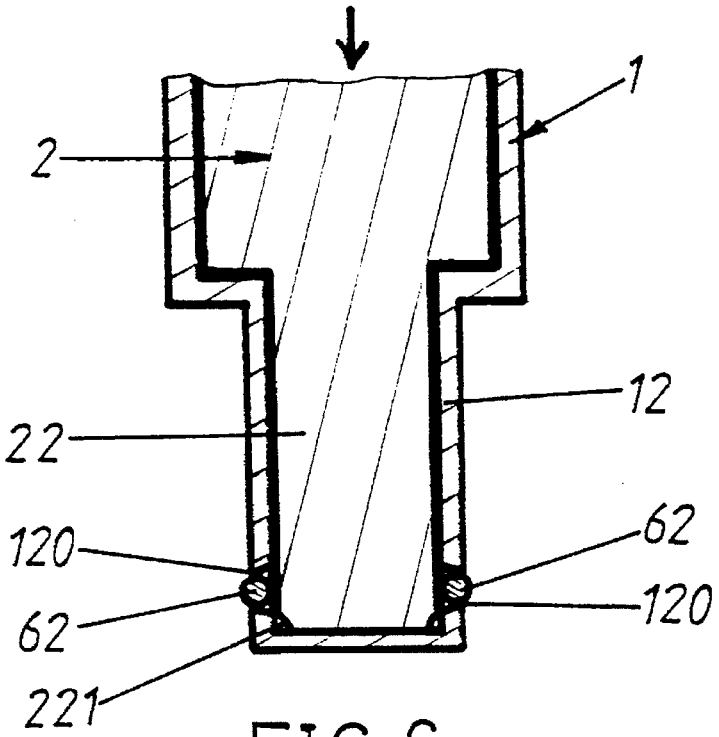
Figure 8:
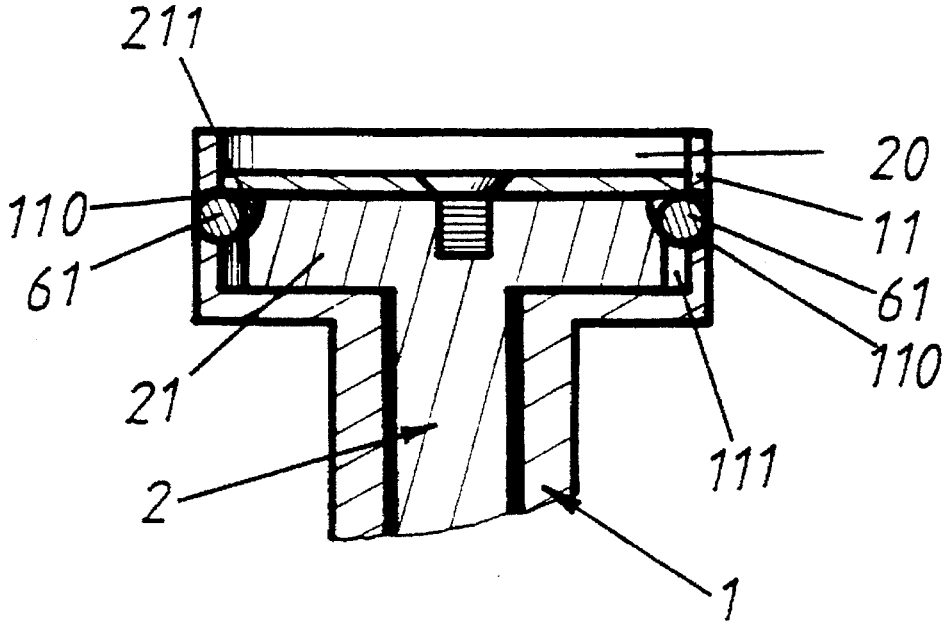
FIGS. 8 and 9 are cross-sectional views respectively showing the second and first positions of the bearing outer race member removing device of the first embodiment of the present invention.

An elongated shaft member 2 which is slidably receivable within the central through hole 10 of the tubular member 1 through the open first end 11 of the tubular member 1 has a first end 21 having an outer diameter substantially corresponding to an inner diameter of the first end 11 of the tubular member 1 to be receivable therein and a second end 22 having an outer diameter substantially corresponding to an inner diameter of the second end 22 of the tubular member 1 to be receivable therein. The shaft member 2 is slidable within the tubular member 1 between a first position (FIGS. 2, 5 and 9) and a second position (FIGS. 6 and 8). The first and second positions of the shaft member 2 are to be further discussed.

Figure 3:
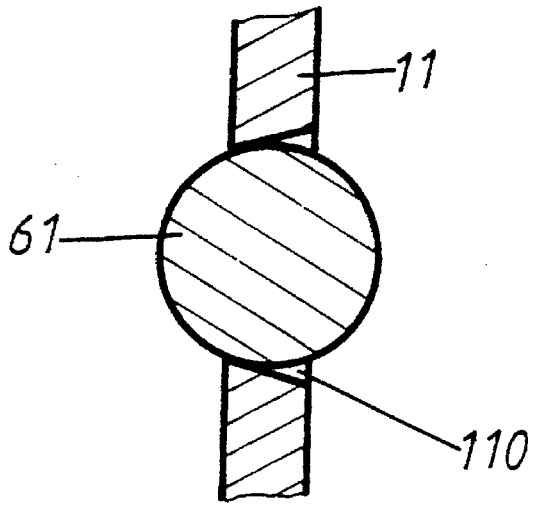
FIG. 3 is a partial cross-sectional view showing a spherical member received within a tapered hole formed on the tubular member of the bearing removing device in accordance with the first embodiment of the present invention.
Figure 9:
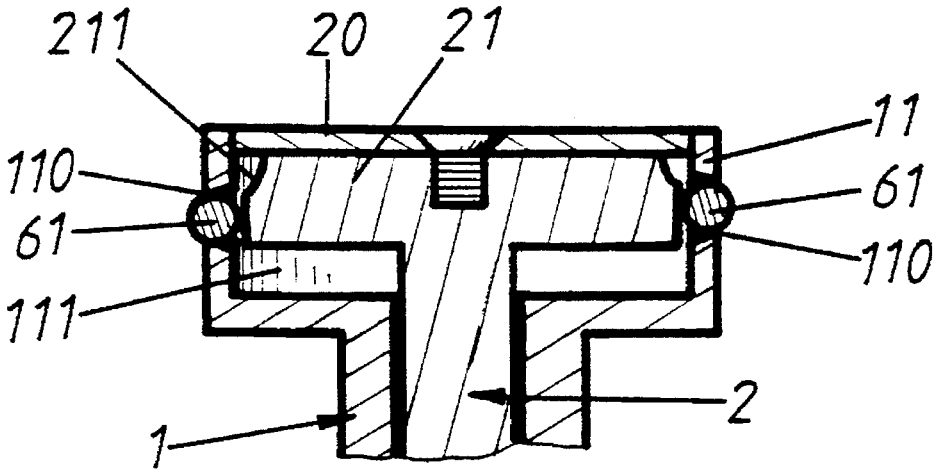

At the first end of the tubular member 1, a plurality of first holes 110 are formed on a circumference thereof, preferably in an angularly equally-spaced manner along the circumference with a spherical member 61, preferably made of steel, retained within each of the first holes 110. A partial cross-sectional view of one of the first holes 110, together with the spherical member 61 disposed therein, is shown in FIG. 3, which first hole 110 has a tapered, outward-converged configuration for retaining the spherical member 61 therein in such a manner to allow the spherical member 61 to partially protrude out of the first end 11 of the tubular member 1. The first end 21 of the shaft member 2 has such a diameter to be in contact engagement with and thus retain the spherical members 61 within the first holes 110 to have the spherical members 61 partially protrude out of the first end 11 of the tubular member 1, as shown in FIGS. 2 and 9.

The first end 21 of the shaft member 2 is also provided with a circumferential groove 211 (FIGS. 2, 8 and 9) which has an inclined surface serving as a camming surface. The circumferential groove 211 is located at such as position that when the shaft member 2 is moved from the first position where the spherical members 61 are retained within the first holes 110 by the first end 21 of the shaft member 2 to partially protrude out of the first end I1 of the tubular member 1 to the second position where the spherical members 61 are allowed to retract into the first end 11 of the tubular member 1 by being partially received within the circumferential groove 211 so that the spherical members 61 are substantially completely shielded within the first end 11 of the tubular member 1, as shown in FIG. 8, and when the shaft member 2 is moved from the second position to the first position, the camming surface of the circumferential groove 211 forces the spherical members 61 to move out of the circumferential groove 211 to partially protrude out of the first end 11 of the tubular member 1.

In the embodiment illustrated, the circumferential groove 211 is formed on the first end 21 of the shaft member 2 at the very end portion thereof so as to form a chamfer. To prevent the spherical members 61 from moving out of the first end 11 of the tubular member 1 through the chamfer 211 when the shaft member 2 is in the second position, a lid 20 is secured to the first end 21 of the shaft member 2 by means of, for example a screw, which lid 20 has a diameter slidably receivable within the open first end 11 of the tubular member 1.

Similar to the first holes 110 formed on the first end 11 of the tubular member 1, having spherical members 61 received therein, a plurality of second holes 120 are formed on the second end 12 of the tubular member 1 along a circumference thereof, preferably in an angularly equally-paced manner, each second hole 120 having an outward-converged, tapered configuration wit a spherical member 62 received therein to be partially protruded out of the second holes 120 by being in contact engagement with the second end 21 of the shaft member 2, as shown in FIG. 6.

The second end 21 of the shaft member 2 is provided with a chamfer-like circumferential groove 221 (FIGS. 5 and 6) having an inclined surface serving as a camming surface to allow the spherical members 62 to partially position therein when the shaft member 2 is in the first position, as shown in FIG. 6.

When the shaft member 2 is moved from the first position (FIG. 6) to the second position (FIG. 5), the spherical members 62 of the second end 12 of the tubular member 1 are forced by the camming surface of the circumferential groove 221 to partially protrude out of the second end 12 of the tubular member 1 and retained at such locations by the second end 21 of the shaft member 2.

Figure 4:
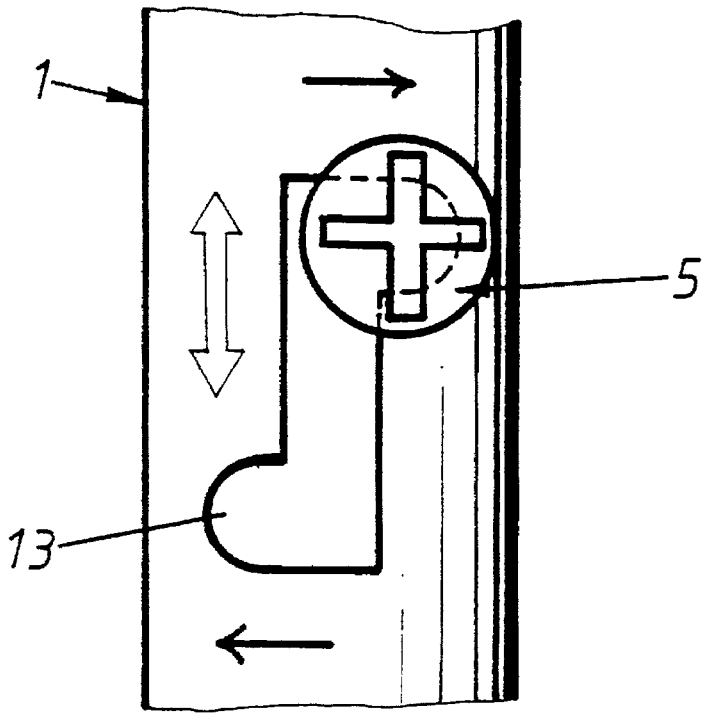
FIG. 4 is a partial side elevational view showing a slot formed on the tubular member for receiving and guiding a handle to move the shaft member relative to the tubular member of the bearing removing device in accordance with the first embodiment of the present invention.

As particularly shown in FIG. 4, to provide a manual control of the movement of the shaft member 2 relative to the tubular member 1, a handle member, which in the embodiment illustrated is a screw 5 engaging an inner threaded hole 23 formed on the shaft member 2, is fixed to the shaft member 1 and extending therefrom through an elongated slot 13 which is formed on the tubular member 1 and extends in the lengthwise direction of the shaft member 2 to be accessible by an operator. By holding and moving the handle member 5 under the guidance of the slot 13, the shaft member 2 is moved within and relative to the tubular member 1 between the first position and the second position thereof.

The elongated slot 13 may be provided with two laterally-directed end extensions, as shown in FIG. 4, to serve as position retaining or locking means for the shaft member 2.

It is obvious that a neutral position of the shaft member 2 relative to the tubular member 1 may be provided or selected between the first and second positions thereof in which neither one of the first and second ends 11 and 12 of the tubular member 1 has the spherical members 61 or 62 partially protruding out thereof.

Figure 17:
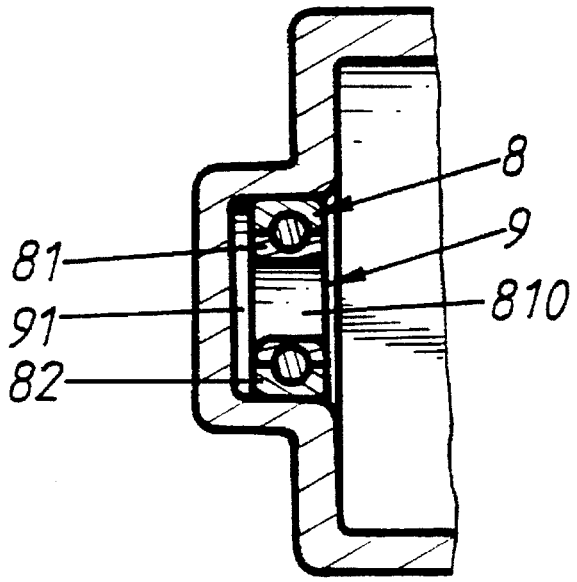
FIG. 17 is a cross-sectional view showing a bearing to be removed fixed inside a bearing seat which is a hole in this case.
Figure 18:
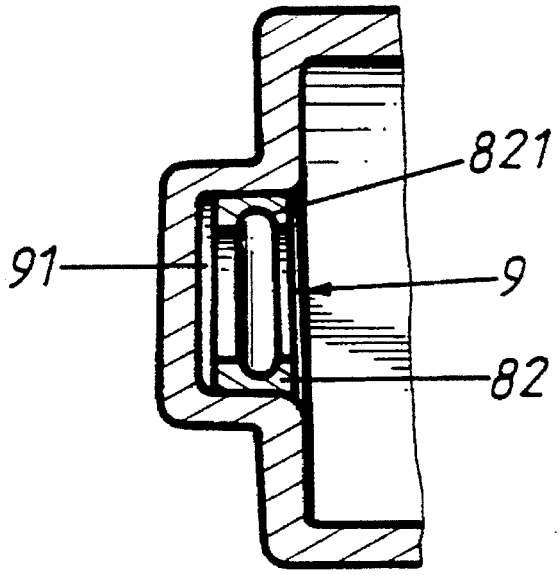
FIG. 18 is a cross-sectional view showing an outer race member of the bearing to be removed.
Figure 19:
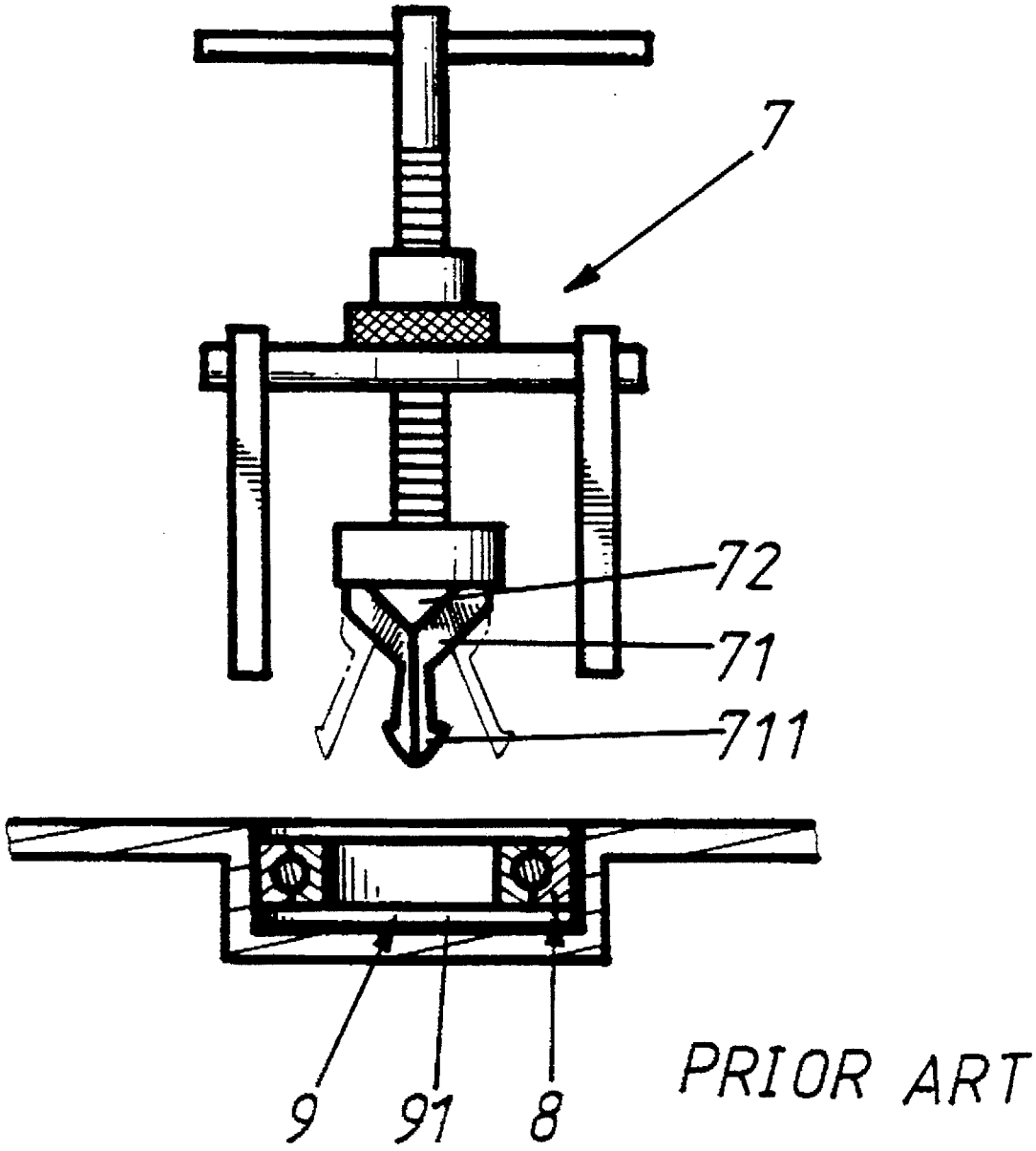
FIG. 19 is a side elevational view showing a conventional bearing removing device used to remove a bearing fixed within a bearing seat.

In use, a support member 4 is provided to support the bearing removing device on the bearing or the parts thereof to be removed, such as the bearing 8 shown in FIG. 17 or the bearing outer race member 82 shown in FIG. 18. The support member 4 in the embodiment illustrated comprises a cylindrical cup-like member having a diameter substantially greater than the tubular member 1. The support member 4 has an end open and the other end closed. The closed end of the support member 4 is provided with a central hole 41 (FIG. 2) through which the tubular member 1 is movably receivable. Threading sections 310 and 320 are provided on the tubular member 1 to respectively correspond to the first end 11 and the second end 12 with nut members 31 and 32 engaging thereon. The nut members 31 and 32 have an outer diameter greater than the diameter of the central hole 41 of the support member 4.

Figure 7:
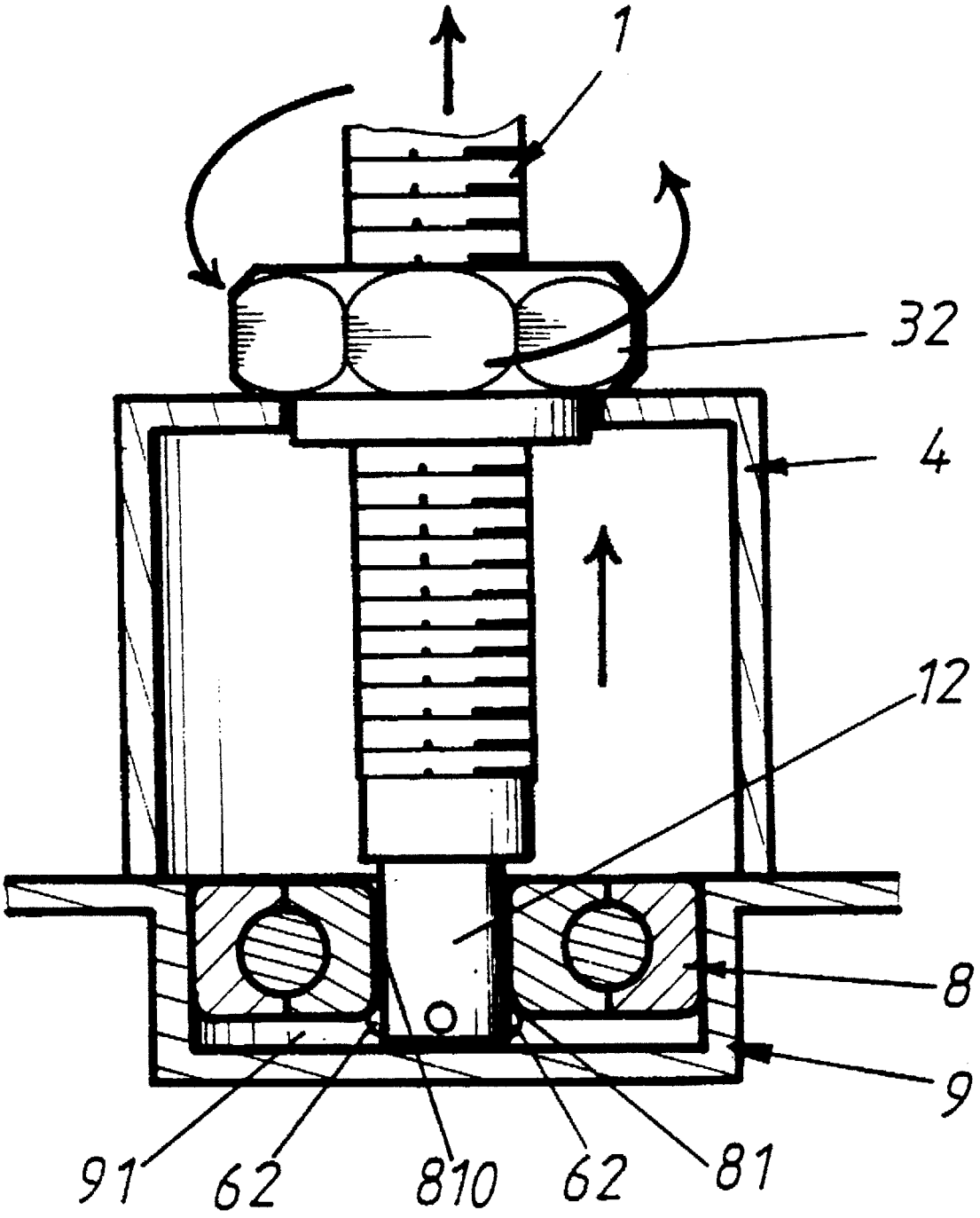
FIG. 7 is a cross-sectional view showing the removal of a bearing with the bearing inner race member removing device of the first embodiment of the present invention.

To remove the bearing 8 shown in FIG. 17 which comprises an inner race member 81, the second end 12 of the tubular member 1 is inserted into the bearing central hole 810, as shown in FIG. 7. The shaft member 2 is then moved to and retained at the second position by means of handle member 5 to force the spherical members 62 of the second end 12 of the tubular member 1 to partially protrude out of the tubular member 1 and enter the spacing 91 between the bearing 8 and the bearing seat 9. By doing so, the spherical members 62 engage the bearing 8 at an inner side of the bearing 8 as shown in FIG. 7. The support member 4 that is fit over the second end 12 of the tubular member 1 is placed around the bearing 8 and on the bearing seat 9 with the open end thereof and the corresponding nut member 32 is rotated against and thus force the tubular member 1, together with the shaft member 2 that is locked at the second position within the tubular member 1, move relative to the support member 4 in a direction away from the bearing 8. By this relative movement between the tubular member 1 and the support member 4 provided by the rotation of the nut member 32, the bearing 8 is gradually pulled out of the bearing seat 9.

Figure 10:
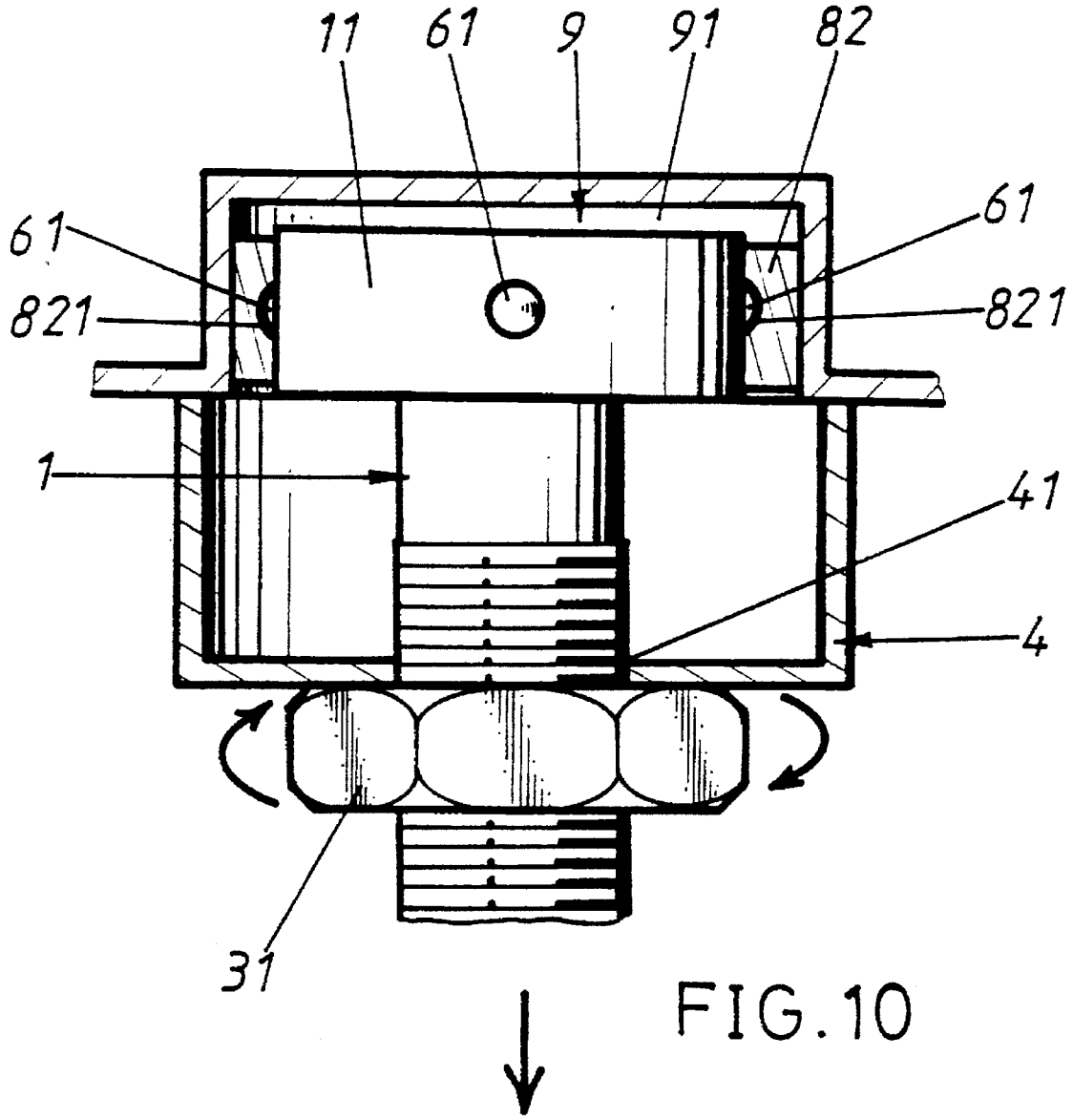
FIG. 10 is a cross-sectional view showing the removal of a bearing outer race member with the bearing outer race member removing device of the first embodiment of the present invention.

In removing a bearing that is damaged to have only the outer race member thereof is left, such as that shown in FIG. 18, the first end 11 of the tubular member 1 is inserted into the outer race member 82 of the bearing with the support member 4 fit over the first end 11 of the tubular member 1, as shown in FIG. 10. The support member 4 is placed on the bearing seat 9 to surround the outer race member 82. The shaft member 2 is moved to and locked at the first position thereof by means of the handle member 5 to force the spherical members 61 to partially protrude out of the first end 11 of the tubular member 1 and to enter the outer race 821 formed on the outer race member 82.

By gradually tightening the nut member 31 against the support member 4 to force the tubular member 1, together with the shaft member 2 locked therein at the first position, to move in a direction away from the outer race member 82, the outer race member 82 can be removed out of the bearing seat 9.

Figure 11:
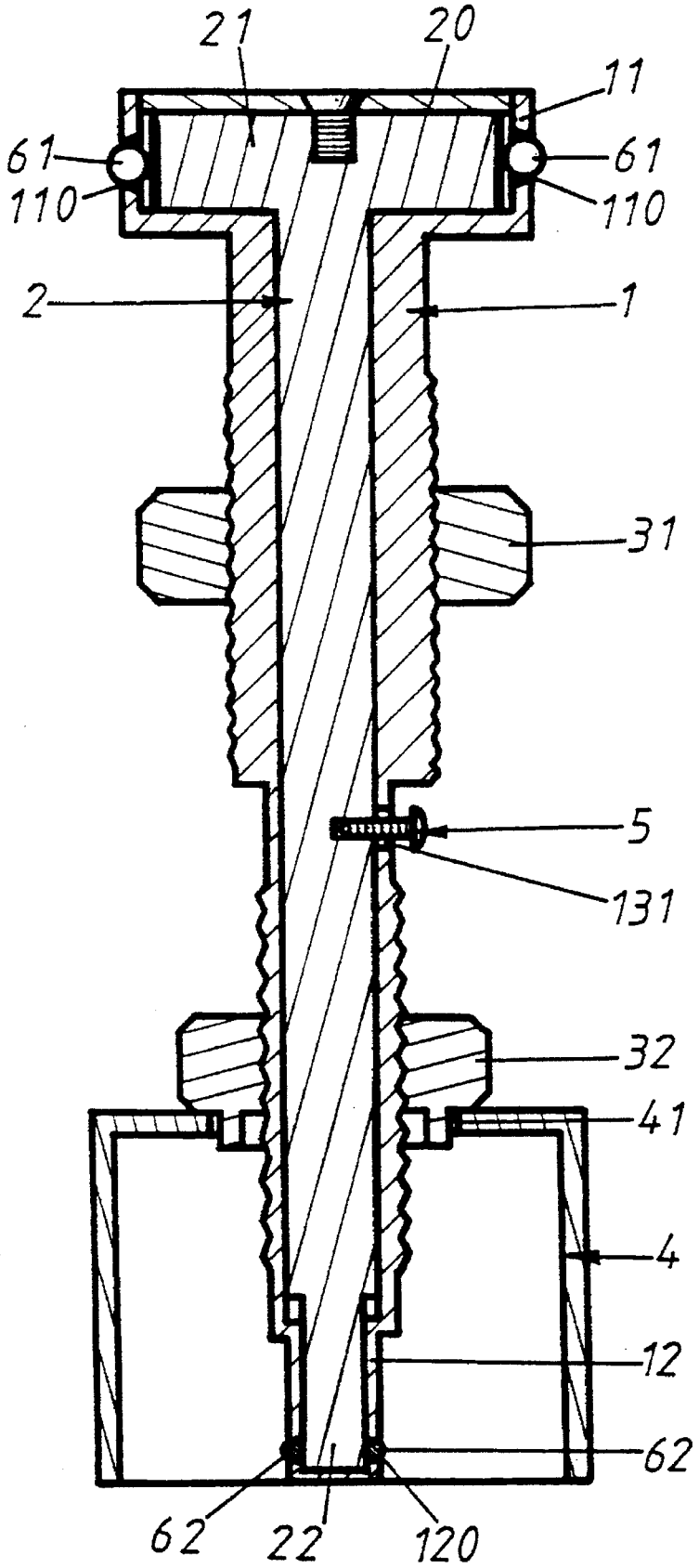
FIG. 11 is a cross-sectional view showing a bearing removing device constructed in accordance with a second embodiment of the present invention.

In FIG. 11, a second embodiment of the bearing removing device constructed in accordance with the present invention is shown. In the second embodiment, parts or members having similar functions as those related to the first embodiment discussed with reference to FIGS. 1 and 2 are referenced with the same numeral. Similar to the first embodiment discussed with reference to FIGS. 1 and 2, the bearing removing device of the second embodiment comprises an elongated tubular member 1 having a bearing outer race member removing means and a bearing inner race member removing means respectively formed at a first end 11 and a second end 12 thereof. The bearing removing device of the second embodiment further comprises a shaft member 2 movably received within a central through hole 10 formed on and extending along the lengthwise direction of the tubular member 1 in such a manner to be rotatable within the tubular member 1 about a lengthwise, central axis of the tubular member 1.

At each of the first and second ends 11 and 12 of the tubular member 1, a plurality of angularly, equally-spaced holes 110 or 120 are formed along a circumference thereof, each hole being tapered and outward converged to allow a spherical member 61 or 62 that is received therein to be partially protruding out of the respective end 11 or 12 of the tubular member 1.

Figure 13:
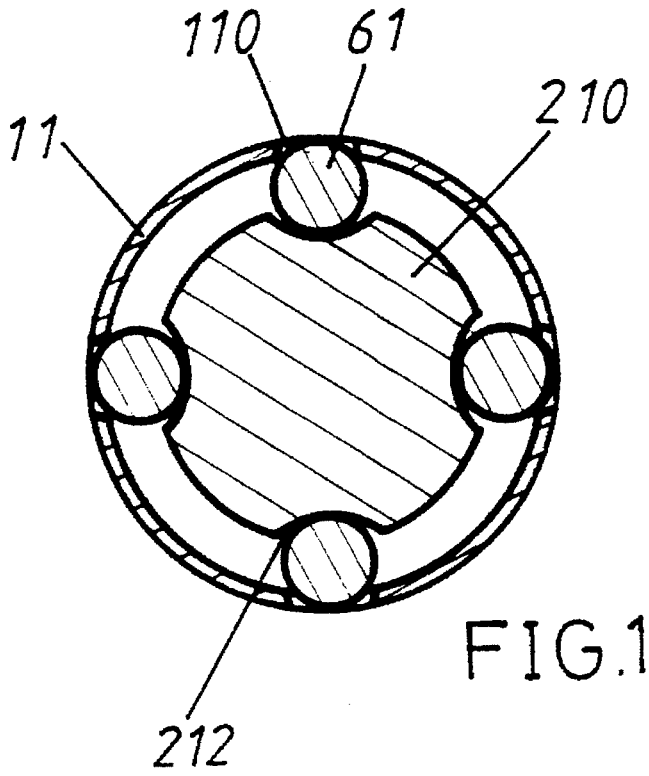
FIGS. 13 and 14 are cross-sectional views respectively showing the second and first positions of the bearing outer race member removing device of the second embodiment of the present invention.
Figure 14:
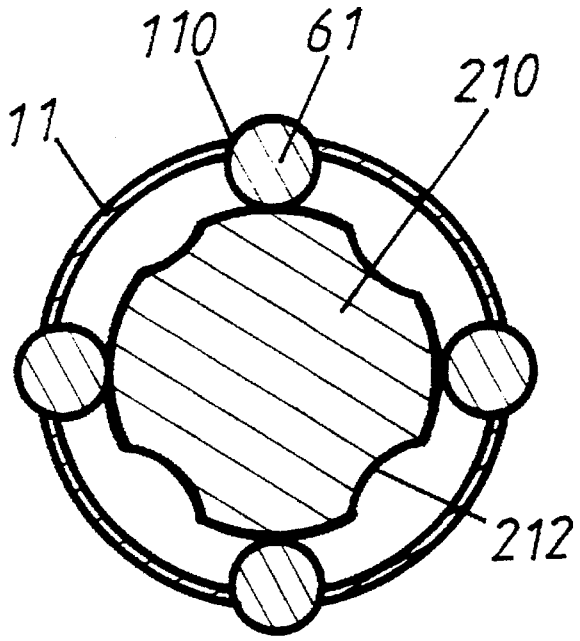

The shaft member 2 has a first end 21 and a second end 22 respectively corresponding to and rotatably received within the first and second ends 11 and 12 of the tubular member 1. The first end 21 of the shaft member 2 has a plurality of slots 212 formed thereon to extend along the lengthwise direction of the shaft member 2 and are preferably disposed in an angularly equally-spaced manner so as to define a plurality of recessed portions and raised portions alternately formed along a circumference of the first end 21 of the shaft member 2 as shown in FIGS. 13 and 14 which are cross-sectional views of the first end 21 of the shaft member 2. The angular spacing between two adjacent recessed portions is substantially corresponding to that of the holes 110 formed on the first end 11 of the tubular member 1 so that by rotating the shaft member 2 relative to the tubular member 1 between a first angular position (FIG. 14) where the spherical members 61 are offset from the recessed portions or corresponding to the raised portions and are forced by the raised portions to partially protrude out of the holes 110 and a second position (FIG. 13) where the recessed portions substantially face the holes 110 and thus allow the spherical members 61 to retract into the first end 11 of the tubular member 1.

Figure 15:
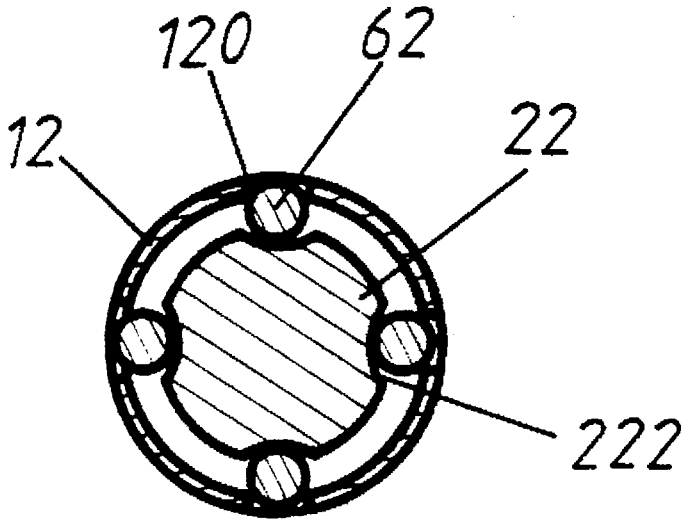
FIGS. 15 and 16 are cross-sectional views respectively showing the first and second positions of the bearing inner race member removing device of the second embodiment of the present invention.
Figure 16:
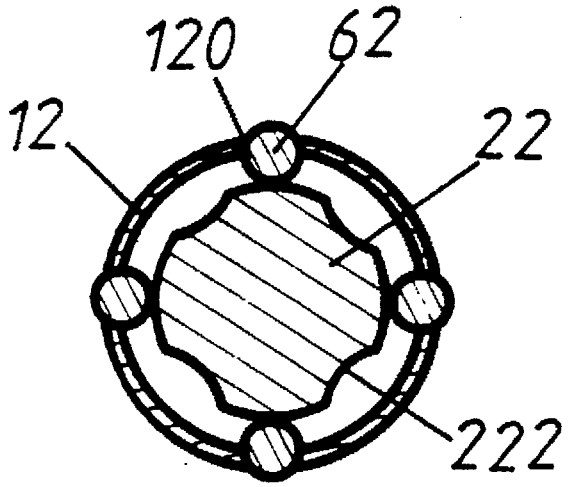

The second end 22 of the shaft member 2 also has a plurality of slots 222 (FIGS. 15 and 16) formed thereon to extend along the lengthwise direction of the shaft member 2. The slots 222 are preferably disposed in an angularly equally-spaced manner to define, along a circumference of the second end 22 of the shaft member 2, a plurality of alternate recessed portions and raised portions so that when the shaft member 2 is rotated between a third angular position (FIG. 15) where the recessed portions substantially face the holes 120 and thus allow the spherical members 62 to retract into the second end 12 of the tubular member 1 and a fourth angular position (FIG. 16) where the spherical members 62 are offset from the recessed portions and corresponding to the raised portions and are forced by the raised portions to partially protrude out of the holes 120.

It is quite apparent that the first angular position of the shaft member 2 relative to the tubular member 1 may be corresponding to the third angular position and the second angular position corresponding to the fourth position. Alternatively the first angular position may be corresponding to the fourth angular position and the second angular position corresponding to the third angular position. It may also be possible that the first, second, third and fourth angular positions are all different.

Figure 12:
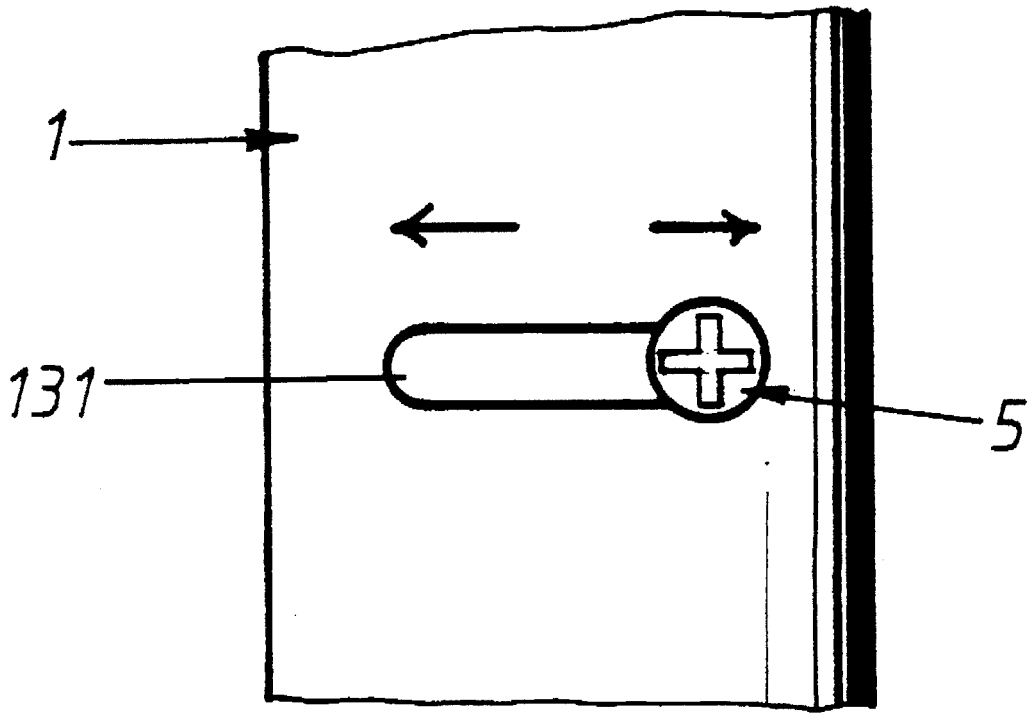
FIG. 12 is a partial side elevational view showing a slot formed on the tubular member for receiving and guiding a handle to move the shaft member relative to the tubular member of the second embodiment of the bearing removing device of the present invention.

To provide a manual control of the rotation of the shaft member 2 relative to the tubular member 1, a handle, such as a screw 5, is fixed to the shaft member 2 and extending therefrom through a slot 131 formed on the tubular member 1 and extending along a circumferential direction thereof to be accessible by an operator, as shown in FIG. 12.

In use, a support member 4 having a central hole (FIG. 11) is fit over either one of the first and second ends 11 and 12 of the tubular member 1 with the first or second end 11 or 12 inserted into the bearing or bearing outer race member to be removed to have the spherical members 61 or 62 partially protruding out of the tubular member 1 to engage the bearing or outer race member (by the rotation of the shaft member 2 relative to the tubular member 1 under the control of the handle member 5). By tightening a corresponding nut member 31 or 32 threadingly engaging threading sections formed on the tubular member 1 against the support member 4, the bearing or the outer race member can then be forced out of the bearing seat in which it is fixed.

It is apparent that although the invention has been described in connection with the preferred embodiments, it is contemplated that those skilled in the art may make changes to the preferred embodiments without departing from the scope of the invention as defined in the appended claims.

What is claimed is:

1. A bearing removing device comprising:

an elongated tubular member having a central through hole and a plurality of first holes formed on a first end thereof and spaced along a circumference to each receive therein a first spherical member, each of the first holes having a tapered and outward converged configuration so as to allow the first spherical member received therein to partially protrude out of the tubular member, the first end of the tubular member configured to be inserted into a bearing seat;

an elongated shaft member received within the through hole of the tubular member in such a manner to allow the shaft member to be movable relative to the tubular member between a first protruding position and a first retracting position, the shaft member having a first end movably received within the first end of the tubular member;

means for retaining the first spherical members partially protruding out of the tubular member and thus engaging the bearing to be removed when the shaft member is in the first protruding position and the first end of the tubular member is inserted into the bearing to be removed;

means for retracting the first spherical members into the tubular member when the shaft member is in the first retracting position;

a support member for supporting the tubular member on the bearing to be removed when the first end of the tubular member is inserted into the inner diameter of the bearing to be removed;

means for applying a force to the tubular member to move the tubular member, together with the bearing engaged by the first spherical members, relative to the support member and thus away from the bearing seat; and means for moving the shaft member relative to the tubular member between the first protruding position and the first retracting position, wherein the retaining means comprises a cylindrical section formed on the first end of the shaft member which is to be in contact engagement with the first spherical members to force the first spherical members to partially protrude out of the tubular member when the shaft member is in the first protruding position and wherein the means for moving the shaft member comprises a handle member fixed to the shaft member and extending externally of the tubular member through a slot formed in the tubular member.

2. The bearing removing device as claimed in claim 1, wherein the retracting means comprises a circumferential groove formed on the first end of the shaft member to receive the first spherical members therein when the shaft member is in the first retracting position.

3. The bearing removing device as claimed in claim 1, wherein the means for applying force comprises a nut member threadingly engaging a threaded section formed on the tubular member and movable to abut against the support member so that by tightening the nut member against the support member, the tubular member is driven to move relative to the support member.

4. The bearing removing device as claimed in claim 2, wherein the slot extends lengthwise in the tubular member and has two ends, each having a transverse end section extending therefrom.

5. A bearing removing device comprising:

an elongated tubular member having a central through hole and a plurality of first holes formed on a first end thereof and spaced along a circumference to each receive therein a first spherical member, each of the first holes having a tapered and outward converged configuration so as to allow the first spherical member received therein to partially protrude out of the tubular member, the first end of the tubular member configured to be inserted into a bearing to be removed out of a bearing seat;

an elongated shaft member received within the through hole of the tubular member in such a manner to allow the shaft member to be movable relative to the tubular member between a first protruding position and a first retracting position, the shaft member having a first end movably received within the first end of the tubular member;

means for retaining the first spherical members partially protruding out of the tubular member and thus engaging the bearing to be removed when the shaft member is in the first protruding position and the first end of the tubular member is inserted into the bearing;

means for retracting the first spherical members into the tubular member when the shaft member is in the first retracting position;

a support member for supporting the tubular member on the bearing to be removed when the first end of the tubular member is inserted into the bearing to be removed;

means for applying a force to the tubular member to move the tubular member, together with the bearing engaged by the first spherical members, relative to the support member and thus away from the bearing seat; and means for moving the shaft member relative to the tubular member between the first protruding position and the first retracting position wherein the first end of the shaft member comprises a plurality of lengthwise slots formed thereon and spaced along a circumference of the first end of the shaft member to define a plurality of alternating raised portions and recessed portions and wherein the means for retaining the first spherical members partially protruding out of the tubular member comprises the raised portions of the first end of the shaft member which are in engagement with the first spherical members to force the first spherical members to partially protrude out of the tubular member when the shaft member is in the first protruding position and wherein the means for retracting the first spherical members comprises the recessed portions of the first end of the shaft member which receive the first spherical members therein when the shaft member is in the first retracting position.

6. The bearing removing device as claimed in claim 5, wherein the means for applying force comprises a nut member threadingly engaging a threaded section formed on the tubular member and movable to abut against the support member so that by tightening the nut member against the support member, the tubular member is driven to move relative to the support member.

7. The bearing removing device as claimed in claim 5, wherein the means for moving the shaft member relative to the tubular member comprises a handle member fixed to the shaft member and extending externally of the tubular member through a slot formed in the tubular member.

8. A bearing removing device comprising:

an elongated tubular member having a central through hole and a plurality of first holes formed on a first end thereof and spaced along a circumference to each receive therein a first spherical member, each of the first holes having a tapered and outward converged configuration so as to allow the first spherical member received therein to partially protrude out of the tubular member, the first end of the tubular member configured to be inserted into a bearing to be removed out of a bearing seat;

an elongated shaft member received within the through hole of the tubular member in such a manner to allow the shaft member to be movable relative to the tubular member between a first protruding position and a first retracting position, the shaft member having a first end movably received within the first end of the tubular member;

means for retaining the first spherical members partially protruding out of the tubular member and thus engaging the bearing to be removed when the shaft member is in the first protruding position and the first end of the tubular member is inserted into the bearing;

means for retracting the first spherical members into the tubular member when the shaft member is in the first retracting position;

a support member for supporting the tubular member on the bearing to be removed when the first end of the tubular member is inserted into the bearing to be removed;

means for applying a force to the tubular member to move the tubular member, together with the bearing engaged by the first spherical members, relative to the support member and thus away from the bearing seat;

means for moving the shaft member relative to the tubular member between the first protruding position and the first retracting position;

a plurality of second holes formed on a second end of the tubular member opposite to the first end and spaced along a circumference thereof to each receive thereon a second spherical member, each of the second holes having a tapered and outward converged configuration so as to allow a second spherical member received therein to partially protrude out of the tubular member, the second end of the elongated tubular member having an outer diameter different from that of the first end of the tubular member and configured to be inserted into an outer race member of a bearing to be removed, the shaft member having a second end movably received within the second end of the tubular member to be movable between a second protruding position and a second retracting position;

means for retaining the second spherical members to partially protrude out of the tubular member and thus engage an outer race of the bearing to be removed when the shaft member is in the second protruding position and the second end of the tubular member is inserted into the inner diameter of the bearing outer race member; and means for retracting the second spherical members into the tubular member when the shaft member is in the second retracting position.

9. The bearing removing device as claimed in claim 8, wherein the means for retaining the second spherical members partially protruding out of the tubular member comprises a cylindrical section formed on the second end of the shaft member which is in engagement with the second spherical members to force the second spherical members to partially protrude out of the tubular member when the shaft member is in the second protruding position.

10. The bearing removing device as claimed in claim 8, wherein the means for retracting the second spherical members comprises a circumferential groove formed on the second end of the shaft member to receive the second spherical members therein when the shaft member is in the second retracting position.

11. The bearing removing device as claimed in claim 8, wherein the second end of the shaft member comprises a plurality of slots formed thereon extending in a lengthwise direction of the shaft member and spaced along a circumference of the second end of the shaft member to define a plurality of alternating raised portions and recessed portions and wherein the means for retaining the second spherical members comprises the raised portions of the second end of the shaft member which are to be in contact engagement with the second spherical members to force the second spherical members to partially protrude out of the tubular member when the shaft member is in the second protruding position and wherein the means for retracting the second spherical members comprises the recessed portions of the second end of the shaft member which are to receive the second spherical members therein when the shaft member is in the second retracting position.

12. The bearing removing device as claimed in claim 8, wherein the first protruding position corresponds to the second retracting position and the second protruding position corresponds to the first retracting position.

* * * * *